US005625946A

United States Patent [19]

Wildeson et al.

[11] Patent Number: 5,625,946

[45] Date of Patent: May 6, 1997

[54] ARMATURE GUIDE FOR AN ELECTROMECHANICAL FUEL INJECTOR AND METHOD OF ASSEMBLY

[75] Inventors: Raymond Wildeson, Yorktown; L. Blair Weaver; David P. Wieczorek, both of Newport News; Benjamin F. Brinn, Jr., Williamsburg, all of Va.

[73] Assignee: Siemens Automotive Corporation, Auburn Hills, Mich.

[21] Appl. No.: 444,497

[22] Filed: May 19, 1995

[51] Int. Cl.[6] ..... F02M 51/06

[52] U.S. Cl. ..... 29/888.41; 239/585.4; 239/600

[58] Field of Search ..... 239/585.1–585.4, 239/900, 600; 251/129.01, 129.15, 129.21; 29/888.03, 888.41

[56] References Cited

U.S. PATENT DOCUMENTS

| | | | |
|---|---|---|---|
| 4,552,311 | 11/1985 | Casey | 239/585.4 |
| 4,662,567 | 5/1987 | Knapp | 239/585.4 |
| 4,832,314 | 5/1989 | Trott | 239/585.3 X |
| 5,222,673 | 6/1993 | Reiter | 239/900 X |
| 5,273,215 | 12/1993 | Hans et al. | 239/533.12 X |

FOREIGN PATENT DOCUMENTS

| | | | |
|---|---|---|---|
| 3318486 | 2/1984 | Germany | 239/900 |

*Primary Examiner*—Kevin Weldon

*Attorney, Agent, or Firm*—Russel C. Wells

[57] ABSTRACT

A low cost method for manufacturing and aligning the upper and lower guide members in a fuel injector reduces manufacturing cost and improves durability. The method teaches the use of an alignment tool to axially align both guide members before the guide members are rigidly secured to the valve body of the injector. The dimensional tolerances on the guide members are loose with the sole exception of the alignment aperture which is closely held.

7 Claims, 2 Drawing Sheets

ARMATURE GUIDE FOR AN ELECTROMECHANICAL FUEL INJECTOR AND METHOD OF ASSEMBLY

FIELD OF THE INVENTION

This invention relates to fuel injectors and more particularly to an improved, low cost upper guide for guiding the reciprocal movement of the armature/needle stem.

BACKGROUND OF THE INVENTION

Fuel injectors are required to be able to undergo hundreds of millions of on/off cycles and still meet the original fluid flow rates and leak performance specifications. The failure to meet and maintain such original performance specifications will result in varying fuel metering to the engine. Some compensation can be made in the engine control system for the overall lean or rich composition of the fuel charge, but for a lean or rich cylinder, such compensation is not always practical. When this happens, the engine may well be unable to meet emission and performance expectations.

The cause of such lean or rich mixtures in a given cylinder can be cause by many factors, one of which is the accuracy of the guiding mechanism for the armature/needle in its reciprocal motion on and off the valve seat. Traditionally injectors have been guided with at least a two point guiding scheme with one guide at the upper end of the armature/needle close to the 'power group' of the injector and the other at the lower end nearer the valve seat.

Still another cause of such performance may be traced to the sealing members in the injector which can cause misalignment of the armature/needle.

Some traditional methods of creating the guide mechanism include utilizing the bore of the valve body for both upper and lower guides. This requires the bore inner diameter to be machined to closely controlled tolerances and then the outer surfaces of the armature/needle are also machined to tight tolerances. Even with this, there may be a required sizing and matching manufacturing operation. Again typically when this is done, the sealing area in the seat of the valve body is also tightly machined to match the sealing area on the pintle valve member or needle valve member depending on the type of valving the injector uses.

Other methods to avoid any misalignment include utilizing a spherical shaped ball geometry at the needle valve member's end as the lower guide. In this case the armature outer diameter guides on a machined surface in the valve body which functions as the upper guide. This is shown in U.S. Pat. No. 5,217,204. This type of design has a guiding advantage due to the ability of a spherical geometry to pivot, but it does require extensive machining in the seat area. Additionally either the seat or the surface of the sphere requires machining to achieve the desired flow passage to the metering area of the valve.

In such an instance as above, the valve body is part of the magnetic return path and therefore, the surface that the armature guides on must be non-magnetic to minimize friction resulting from the magnet's attraction. To accomplish this, there is a separate piece that is attached to the valve body and then machined with the valve body to insure centering of the armature/needle. This requires very close tolerance machining over an extended distance.

As taught in U.S. Pat. No. 4,915,350, one method to solve this has been sizing and attaching a non-magnetic thin guide onto the top of the valve body. This will lower the cost due to the minimization of a machining that is required. Some drawbacks are if the actual attachment of the guide is with a staking operation, such operation creates small metallic particles which can potentially be a source of injector contamination and subsequent injector failure. If the thin guide is located in a recess in the valve body, an additional machining operation must be performed on the valve body to accept a portion of the thickness of the already thin guide. To allow for the stacking, the valve body must have additional space in the diameter to accommodate the material necessary for the geometry for the retention of the guide.

In other applications, although the guide is sized during the attaching operation, the centering of the upper guide to the lower guide is dependent upon the tolerances built into the valve body. The guide conforms to the position of the valve body inner diameter. When the sizing tool is removed, the lower end of the guide has a tendency to spring back some due to the properties of the metal. This leaves a potential sharp area to gouge into the armature.

SUMMARY OF THE INVENTION

The above identified problems, expenses and deficiencies are solved by the armature guide means for an electromechanical fuel injector having an axially aligned stator and armature means. An electromagnetic coil surrounds the stator means. A spring means biases the armature means from the stator means. The armature means includes a valve stem member having a spherical surface at one end opposite the stator means. A valve seat member including an lower guide member, a valve seat, sealing means and an orifice member is positioned in the valve body. The valve body member has a first bore with an inner diameter extending from one end adjacent to the stator means and a second bore with an inner diameter larger than the inner diameter of the first bore extending from the other end a distance intermediate the ends and forming a shoulder.

The upper guide member is positioned at the one end of the valve body member. The guide member is substantially L-shaped in cross-section with a tubular member extending along one of the L-shaped surfaces with an inner diameter and an outer diameter that is less than the inner diameter of the first bore. The inner diameter of the tubular member forms an elongated surface which is a sliding fit with the armature means. An end surface radially extends along the other of the L-shaped surfaces from one end of the tubular member, and has an outer diameter larger than the inner diameter of the first bore in the valve body.

DETAILED DESCRIPTION

Figure 1:
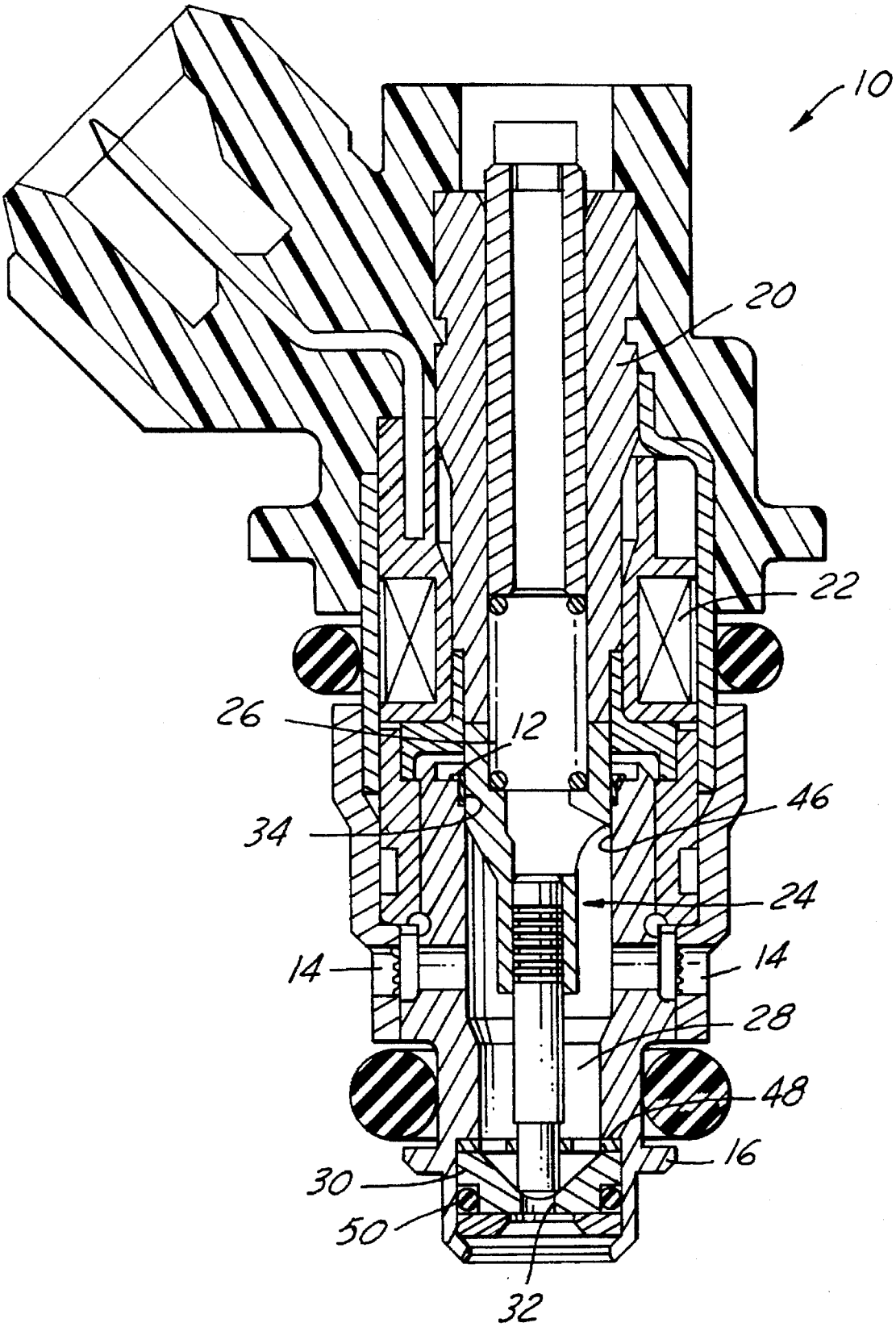
FIG. 1 is a cross-section view of a fuel injector having the upper guide.

Referring to FIG. 1, there is illustrated in cross section an electromagnetic fuel injector 10 utilizing the upper guide member 12 of the present invention. Inasmuch as the operation of fuel injectors is well known, only the necessary elements of the injector around the upper guide member will be described.

The injector 10 illustrated is a somewhat tubular, small injector in both outside diameter and height. More particularly the injector 10 is a bottom feed injector in that fuel is supplied to the injector through one or more fuel inlets 14 in the valve body 16 and exits from the injector through a orifice member 18 at the adjacent end of the injector. A top feed injector, in which fuel enters at one end of the injector, flows through the injector and exits from the injector through an orifice member at the opposite end, also uses the upper guide member 12.

The injector has a stator means 20 surrounded by an electromagnetic coil 22 to which is connected a source of potential to actuate the injector. An armature member 24 is coaxially positioned to the stator means and is biased away from the stator by means of a spring 26. At the opposite end of the armature member 24 is a valve stem member 28 that is secured to the armature by some means such as an interference fit or by welding or some other similar means. As illustrated the valve stem member 28 has an reduced diameter at one end. That one end is terminated in a spherical surface for mating with the valve seat member 30 to close a flow through passageway 32 for ejecting fuel from the injector. Downstream of the valve seat member 30 is the orifice member 18 having one or more orifices for metering fuel from the injector.

The armature member 24 is located in an inner bore 34 of the valve body 16 member which is secured to the stator member 20 by means of a one more intermediate members which are rigidly secured to one another by means of laser welding or the like.

Figure 2:
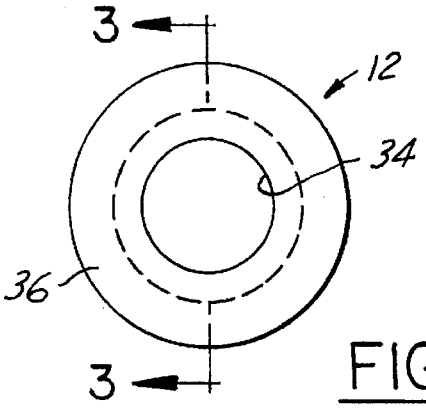
FIG. 2 is a plan view of a typical upper guide of the embodiments herein.
Figure 3:
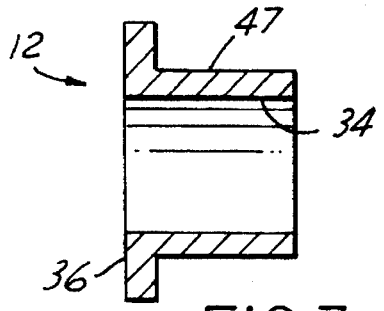
FIG. 3 is a section view taken along line 3—3 of FIG. 2.

Located at the end of the valve body 16 opposite the valve seat end is the upper guide member 12. In general, the upper guide member may be considered to be an eyelet shaped member as illustrated in FIGS. 2 and 3. The guide member 12 has a first surface 34 which is parallel to the axis of the guide member having a first inner diameter that guides the armature member 24. Extending radially outwardly and concentric with the first surface 34 is an end surface 36 that is substantially perpendicular to the first surface.

Figure 4:
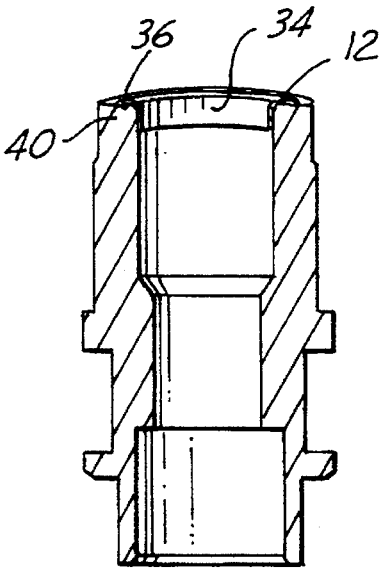
FIG. 4 is an enlarged section view of the valve body with the upper guide.

This is better illustrated in FIG. 4 which illustrates the upper guide member 12 having an L-shaped cross section. The upper guide member 12 is a non magnetic, circular tubular member having an inner diameter forming the first surface 34 for mating with and providing a sliding surface for the armature 24 to move in a reciprocal manner. The top or end surface 36 of the upper guide member extends away from the inner diameter provides means for laser welding 40 the guide member 12 to the valve body member 16 during assembly as will hereinafter be described. The inner diameter 34 must be presized which will then not have any spring back from the sizing tool as discussed in the prior art.

Figure 5:
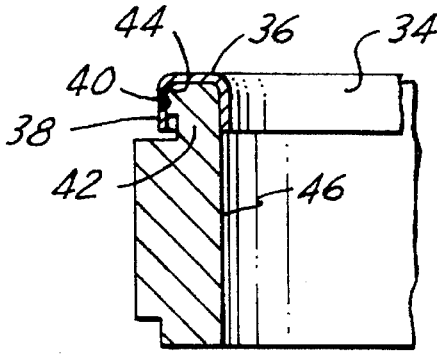
FIG. 5 is an embodiment of the upper guide.
Figure 6:
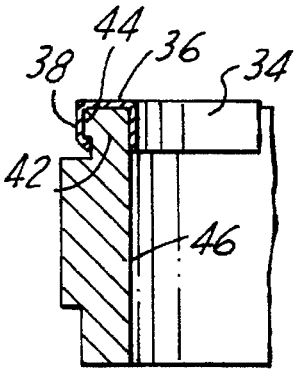
FIG. 6 is a third embodiment of the upper guide.
Figure 7:
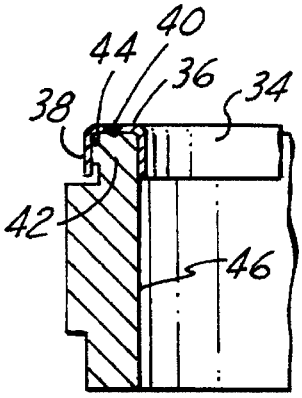
FIG. 7 is yet another embodiment of the upper guide.

Other embodiments of the guide member 12 are illustrated in FIGS. 5–7. In these embodiments, the guide member 12 is a U-shaped member wherein at the outer perimeter of the end surface 36 is a downwardly depending end 38 that is substantially parallel to the first surface 34. When the guide member 12 is U-shaped, the end surface 36 is the bottom of the "U" and extends from the first surface 34 to the outer diameter or second diameter 47 of the depending end which compose the legs of the "U". The outer leg of the "U" is the second surface 38. In each of the embodiments, the guide member is positioned on the valve body 16 with the end surface 36 away from the valve seat member 30.

In FIG. 5, the valve body member 16 has a knob end 42 over which the end surface 36 of the tubular guide member 12 is located. The inside surface 44 of the second surface 38 of the guide member formed to lie around the knob end. The guide member 12 forms an interference fit over the knob end 42 and with the second surface of the guide member 12 bending under the knob end, so that the guide member remains in position. The guide member is secured to the valve body 16 by means of laser welding 40. Another means of securing the guide member to the valve body is by a magna form process to distort the outer leg of the guide member and keep it in place. Various other means of capping over the guide member and locating the cap in a press fit relationship with the stator member or one of the intermediate members is well known.

FIG. 6 illustrates the use of the same knob end 42 of the valve body 16. In this embodiment the cross section of the guide member 12 has both legs that are positioned over the knob end of the valve body 16. When in the proper position, the outer leg 38 of the guide member 12 is formed to crimp under the knob. A weld may be used to secured the guide member. This weld again is typically a laser weld and the weld need not be continuous but only a spot weld in a few places around the end surface of the guide member 12.

FIG. 7 illustrates yet another embodiment of the guide member 12 with the knob end 42 of the valve body 16. This is similar to the embodiment of FIG. 5 except that the weld 40 is positioned on the end surface 36 of the guide member 12.

In each of the embodiments of FIGS. 5–7, the diameter of the bore 46 in the valve body 16 is greater than the second diameter 47 of the tubular guide member 12 for the reasons will be become apparent hereinafter.

Figure 8:
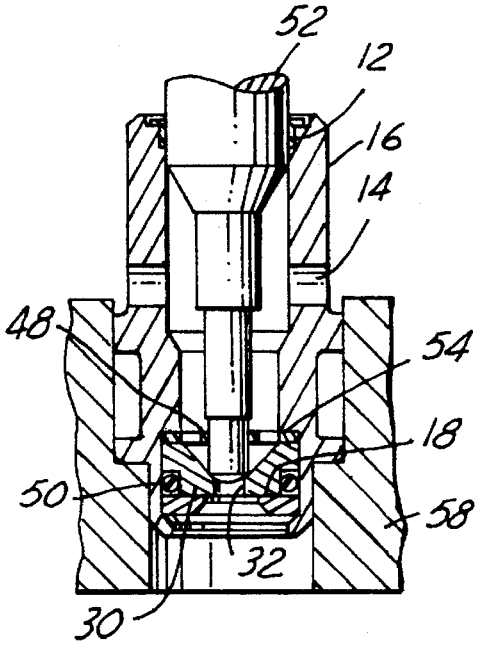
FIG. 8 is an illustration of the practice of the method of aligning.

To assemble and secure the guide member in each of the above embodiments and as illustrated in FIG. 8 the lower guide member 48 is positioned in the valve body member 16. The valve body member has the valve seat member 30 the lower guide member 48 and the orifice member 18 along with any seals 50 positioned and secured to the lower end of the valve body. The lower guide member 48 is radially free to be positioned in its proper place. This assembly is positioned in an assembly jig 58 as illustrated in FIG. 8.

The upper guide member 12 is positioned on the upstream end of the valve body member 16 extending along the bore diameter 46 of the valve body member. The upper guide member 12 is free to radially float in the bore 46. The lower guide member 48, also floats in a radial direction. An alignment tool 52, which is essentially the shape of the armature/needle member is inserted through both the upper guide member 12 and the lower guide member 48 and rests on the valve seat member 30. The alignment tool 52 is axially aligned with the valve seat member 28 and aligns the upper guide member 12 and the lower guide member 48. The valve seat member 30 is then secured to the valve body member 16 by such means as forming the end of valve body member 16 to press the lower guide member 48 against a shoulder 54 formed by a counterbore in the valve body member 16, thereby locking the lower guide member 48 in place. The upper guide member 12 is then secured to the valve body by means of forming as in FIG. 6, or welding as illustrated in FIGS. 4, 5 or 7. The alignment tool 52 is removed and the completed assembly is then assembled to the power group of the injector including the correct armature/needle assembly.

With the use of the upper guide member 12 as described, the dimensional tolerances of the upper and lower guide members are such that with the alignment tool 52, the guide members 12 and 48 are centered. This requires only the tolerances of the first surface 34 in the upper guide member 12 and the inner bore of the lower guide member 48 to be closely held. In addition, the valve seat member 28 can also have much looser tolerances on its outside diameter as the assembly of the valve seat member and the lower guide member 48 is accomplished at the same time as the upper guide member 12. In this instance, the alignment tool 52 makes sure that all of the armature/needle guiding surfaces are aligned and then the valve seat member 30, lower guide member 48, orifice member 18 and the orifice back up member 56 are secured to the valve body by means again such as laser welding, crimping or magna forming. The use of loose tolerance parts results in a low cost, high durability injector which is the required end result.

What is claimed is:

1. A method for aligning the upper and lower armature guides in an electromechanical fuel injector wherein the armature has a tubular shaped end adjacent the stator means and an elongated valve stem extending from the tubular shaped end, said method comprising the steps of:

forming at least two bores in a valve body member, one bore axially extending the length of the valve body member and having a first diameter, a second bore having a second diameter extending from one end of the valve body to a point intermediate the ends and forming a shoulder at the intersection of the two bores;

inserting a lower armature guide member in said second bore, said lower guide member having an outer diameter smaller than the diameter of said second bore, the lower guide member having an axially concentric diameter forming a sliding fit with the valve stem;

inserting a valve seat member having a valve seat axially concentric with an axially extending through hole, a sealing means and an orifice member against the lower guide member forcing the lower guide member against the shoulder;

positioning an upper armature guide member on the end of the valve body member opposite the lower guide armature member, the upper guide member having an axially concentric diameter forming a sliding fit with the tubular shaped end of the armature;

axially aligning the concentric diameters of the lower and upper guide members with an aligning tool so that the armature reciprocally moves along the axis of the valve body member and the valve stem is centered on the valve seat member and closes the through hole;

securing the valve seat member, lower guide member, orifice member and orifice back up member to the valve body;

securing the upper guide member to the valve body member; and then removing the aligning tool.

2. A method for aligning the upper and lower guides of an armature means according to claim 1 wherein the step of securing the upper guide member is by means of laser welding.

3. A method for aligning the upper and lower guides of an armature means according to claim 1 wherein the step of securing the upper guide member is by means of magna forming.

4. A method for aligning the upper and lower guides of an armature means according to claim 1 wherein the step of securing the upper guide member is by means of crimping.

5. A method for aligning the upper and lower guides of an armature means according to claim 1 wherein the step of securing the valve seat member, lower guide member, and orifice member to the valve body is by means of crimping the end of the valve body member over the orifice back up member to locate the lower guide member against the shoulder in the valve body member.

6. An electromechanical fuel injector comprising:

a stator means;

an armature member co-axially aligned with said stator means, said armature member having a co-axial valve stem member;

an electromagnetic coil surrounding said stator means and operable to reciprocally move said armature member to and from said stator means;

a tubular valve body member having an axially extending bore and a knob means at one end, said valve body member integral with said stator means and including a valve seat member at the other end, said valve body member aligning said armature member for reciprocal movement of said valve stem member on and off said valve seat in response to said coil;

a lower guide member coupled to said valve seat member and axially aligned with said axially extending bore;

a substantially U-shaped upper guide member overlying said knob means on said valve body member and having an axially extending surface forming an elongated surface along said bore forming a sliding fit with said armature member, said upper and lower guide members operable to align said armature member and said valve stem member with said stator means and said valve seat member;

a housing member enclosing said coil member and said valve body member, said housing having a fuel inlet means for receiving fuel to be controllably discharged through said valve seat member when said valve stem member is moved off said valve seat member under control of said electromagnetic coil.

7. An electromechanical fuel injector according to claim 6 wherein said axially extending outer surface is formed to wrap around said knob means.

* * * * *